United States Patent [19]

Ban et al.

[11] 4,013,517

[45] Mar. 22, 1977

[54] CIRCULAR TRAVELING GRATE SINTERING MACHINE

[75] Inventors: Thomas E. Ban, South Euclid; Roger L. Hulette, Berea; Subir K. Mittra, Euclid, all of Ohio

[73] Assignee: McDowell-Wellman Engineering Company, Cleveland, Ohio

[22] Filed: Sept. 29, 1975

[21] Appl. No.: 617,849

[52] U.S. Cl. ..... 202/262; 198/796; 198/483; 198/365; 202/216; 202/238; 214/17 CC; 266/178; 266/179; 23/279; 432/238

[51] Int. Cl.[2] ..... C10B 33/00; B65G 49/00; F27D 1/12

[58] Field of Search ..... 23/279; 202/216, 238, 202/262; 198/38, 42, 66, 796, 365, 483; 214/17 CC; 266/21, 36, 178, 179; 432/137, 138, 241, 235; 34/135, 186, 217

[56] References Cited

UNITED STATES PATENTS

| | | | |
|---|---|---|---|
| 3,302,936 | 2/1967 | Ban | 23/279 |
| 3,460,818 | 8/1969 | Greaves et al. | 266/21 |
| 3,589,691 | 6/1971 | Greaves | 432/137 |

*Primary Examiner*—Morris O. Wolk
*Assistant Examiner*—Michael S. Marcus
*Attorney, Agent, or Firm*—McNenny, Pearne, Gordon, Gail, Dickinson & Schiller

[57] ABSTRACT

A circular traveling grate machine is disclosed, which is particularly suitable for educting oil from oil shale. The machine includes generally circular inner and outer walls mounted for movement along a trackway and which carry a plurality of burden conveying pallets, hinged to the outer wall and releasably connected to the inner wall. As each pallet approaches and enters a burden discharge station, the connection between the pallet and the inner wall is released. The pallet is then guided downwardly to a discharge position by a piston and cylinder as each pallet is pivoted on its hinge under the influence of gravity. Each lowered pallet is raised by a piston and cylinder and latched in a burden carrying position to the inner wall. The pallets and walls are supported for rotation along the trackway by water cooled supporting grid to minimize differential expansion and contraction of component parts of the machine as they are subjected to differential temperatures.

11 Claims, 7 Drawing Figures

CIRCULAR TRAVELING GRATE SINTERING MACHINE

BACKGROUND OF THE INVENTION

This invention relates generally to a circular traveling grate for recovering oil from oil bearing materials such as shale and, more particularly, to a traveling grate machine having a new and improved mechanism to discharge spent shale from the grates and a water-cooled frame structure. As is pointed out in U.S. Pat. No. 3,325,395, extremely large deposits of oil bearing shale are known to exist in the United States and particularly in Colorado and Wyoming. Shale rock and certain oil sands contain a substance called "kerogen" or "petrogen," which is an organic waxy compound. When heated to a temperature of about 800° F, it cracks partially to yield a substance which has the properties resembling crude oil. In fact, any organic or organic containing material will yield such a substance when treated in that manner.

The United States Bureau of Mines has conducted considerable experimental work on the recovery of shale oil from these western deposits. Its studies have resulted in the shaft furnace method of recovery of the oil, whereby a quantity of oil bearing rock is deposited in a vertical furnace and submitted to an updraft of heated gasses. This technique produces relatively small amounts of oil and is somewhat inefficient due to the turbulence in the shaft furnace. Another independent investigation utilizing a retort method of recovery, which is similarly inhibited, utilizes a downdraft procedure followed by recovery of the kerogen components from the gasses.

A continuous machine for removing oil from oil shale is shown in U.S. Pat. No. 3,302,936. The machine disclosed therein is a circular traveling grate machine, having a plurality of pallets which are movable along a circular trackway, mounted on a conventionally designed superstructure. A stationary hood and wind ducts are mounted above and below the trackway. Crushed shale is brought to the machine and deposited on the pallets, and the pallets then move through successive zones where hot gasses are fed downwardly through the burden to remove the oil in the form of a mist. In a second zone the shale is cooled by forcing gas upwardly through the burden.

The pallets are then moved to a dumping zone where the spent shale is discharged. The arrangement set forth in U.S. Pat. No. 3,302,936 for dumping the pallets includes the pallets being mounted on a pair of wheels located at the leading edge of the pallet and by a third wheel adjacent its trailing edge. The two leading wheels are located on tracks positioned outside the combustion zone, while the third wheel glides along an interior track. The pallets are dumped by being pivoted on the leading wheel axle as the trailing wheel follows a downwardly dipped portion of the central trackway, which is located within the combustion zone.

While this dumping arrangement is suitable for many materials, it has been found that an oil shale environment is particularly hostile with respect to the trailing wheel, its bearing, and the internally located track. This type of a dumping procedure is known in the art as an axial dump and a further problem is involved when the pallets are dumped in this manner. The leading edge of the pallet forward of the front wheels must tilt above the normal horizontal plane of the pallet when it enters the discharge zone. Frequently, this front edge is not able to be raised by the weight of the pallet due to bridging or fusion of the material in the discharge zone. This is particularly true when the depth of the burden may be between 8 and 10 feet.

SUMMARY OF THE INVENTION

This invention provides a circular traveling grate machine which is particularly suited for educting oil from oil shale, and which includes an improved technique for discharging the spent burden from the pallets. The invention also provides an improved water-cooled supporting frame or grid, which minimizes differential expansion and contraction of component parts of the machine as they are subjected to differential temperatures.

More specifically, there is provided a circular traveling grate machine having pallets which are pinned to one of the burden confining side walls of the machine so that the center trackway and the pallet roller within the burden treating zone are eliminated. Desirably, the pallets are hinged to the outer burden confining wall and pinned to the inner burden confining wall so that they swing downwardly under the influence of gravity at the discharge station. In such an arrangement, hydraulic pistons and cylinders are employed to guide the pallets to their lowered position and to raise the pallets to their normally horizontal position after the dumping operation. Of course, other lowering mechanisms or guides may be employed without departing from the scope of this invention. Furthermore, the pallets may be axially dumped pallets with the trailing edge of the pallet pinned to a wall and then dumped axially by removing the pin. In this instance, guide mechanisms would be employed to lower and raise the pallets.

According to another aspect of the present invention, the supporting grid or frame for the burden confining walls and pallets is water-cooled to minimize differential expansion and contraction of component parts of the machine when they are subjected to differential temperatures. In the disclosed embodiment of the invention, this grid includes inner and outer concentric supporting beams which are hollow and are adapted to receive circulated water. Those inner and outer beams are connected by radial beams which are hollow and communicate with the circular beams.

DETAILED DESCRIPTION OF THE INVENTION

Figure 1:
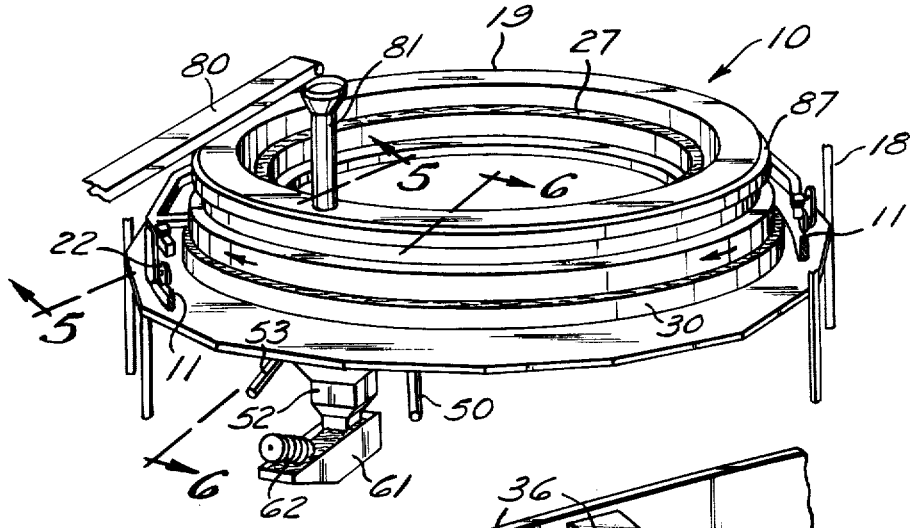
FIG. 1 is a semi-schematic perspective view of a circular traveling grate machine according to this invention.
Figure 4:
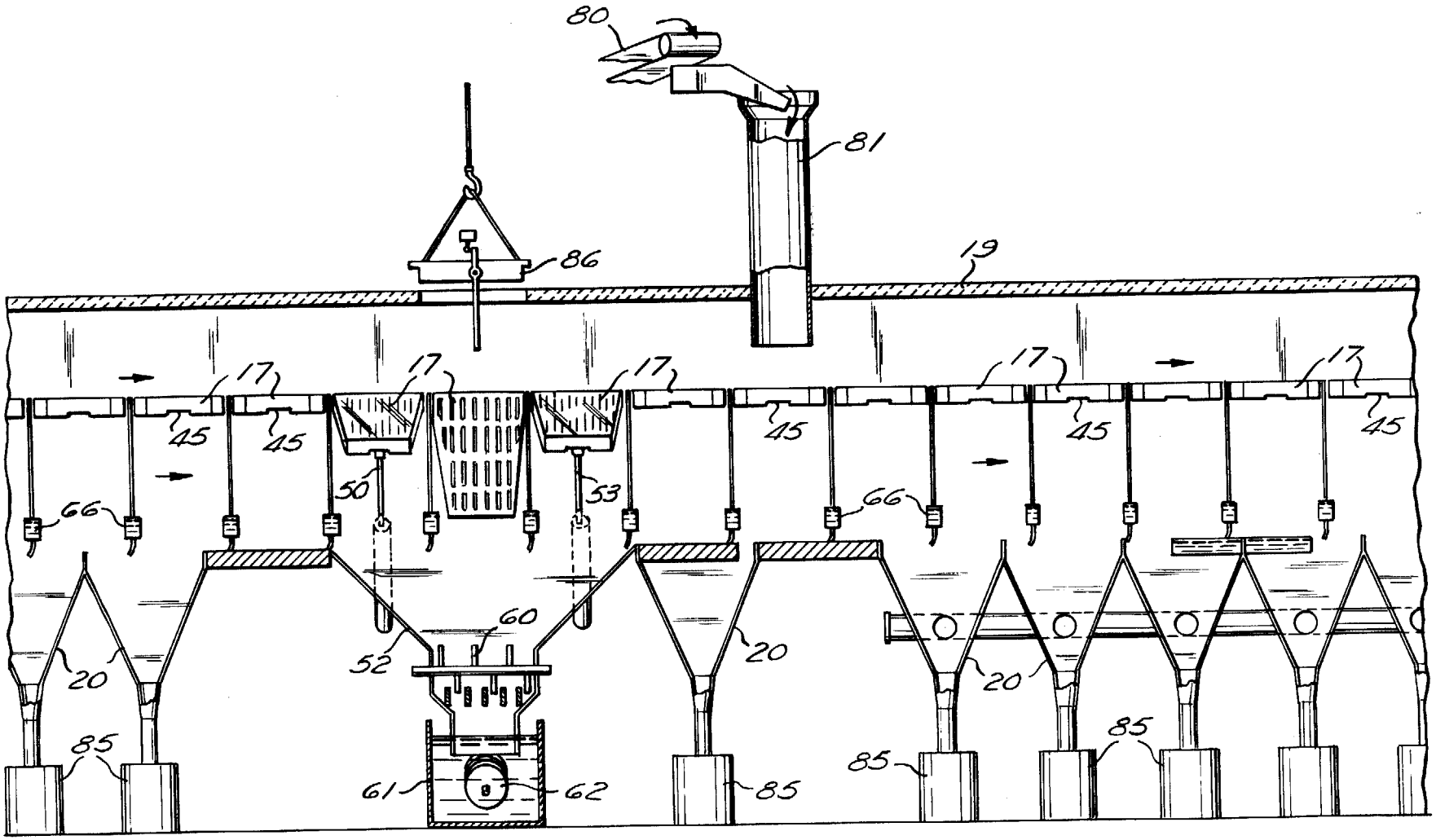
FIG. 4 is a developed cross sectional view of a section of the machine viewed from its inside.
Figure 5:
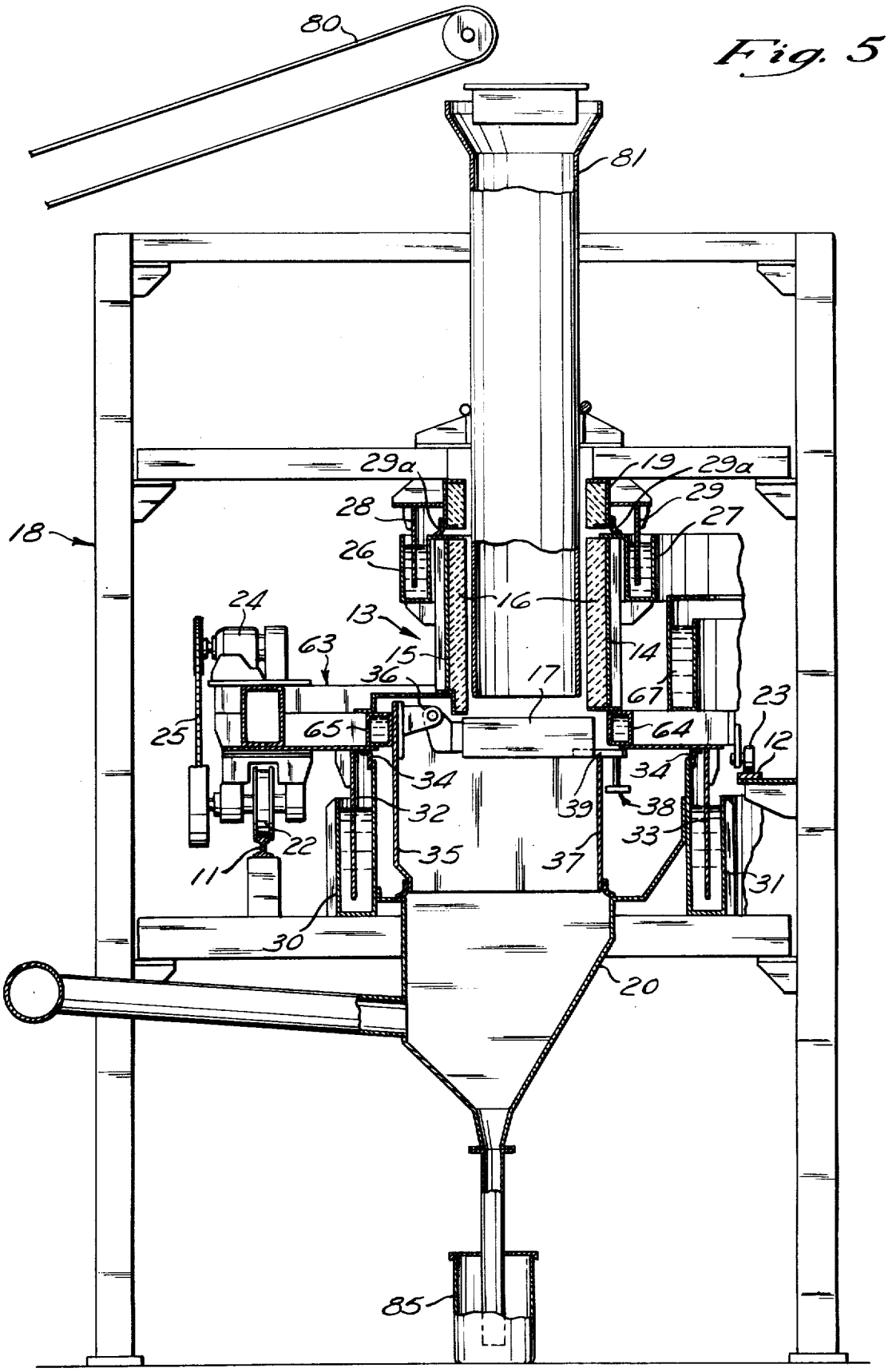
FIG. 5 is a fragmentary cross sectional view of the machine, the plane of the section being indicated by the line 5—5 in FIG. 1.

Referring now to the drawings, there is shown a traveling grate machine 10. The machine 10 is generally circular in construction and includes circular trackway means comprising the tracks 11 and 12 (FIGS. 4 and 5). Mounted for movement along the trackway in the direction indicated by the arrows in FIGS. 1 and 4 is an annular burden confining means 13. The burden confining means includes spaced inner and outer walls 14 and 15, lined with a suitable refractory 16 and a plurality of gas permeable pallets 17. The rails 11 and 12 are supported on any suitable superstructure, generally indicated at 18, framed from conventional structural members.

Mounted above the inner and outer walls on the superstructure 18 and above the pallets 17 is a stationary gas confining chamber or hood 19. Mounted below the pallets 17 on the superstructure 18 is a second stationary, gas confining chamber or windbox 20. The burden confining means 13 is mounted on a supporting grid 63, which will hereinafter be described in greater detail, for rotation about the trackway means. As may be seen most clearly in FIG. 5, the supporting grid 63 and, therefore, the burden confining means 13 are mounted for movement by an outer multiplicity of wheels 22 and an inner multiplicity of rollers 23. Each wheel 22 is driven by its own motor 24 through a chain 25.

There is provided a seal between the hood 19 and the chamber 13 and between the windbox 20 and the chamber 13. The seal between the hood 19 and the chamber 13 comprises an outer trough 26 and an inner trough 27 into which are received circular plates 28 and 29, respectively. The troughs 26 and 27 are filled with water to provide an effective liquid seal between the chamber 13 and the atmosphere. To prevent dust and dirt from accumulating in the troughs 26 and 27, sliding wiper seals **29*a* are provided. Similarly, the windbox 20 is sealed relative to the chamber 13 by an outer trough 30 and an inner trough 31. Circular plates 32 and 33 respectively project into the troughs 30 and 31. The troughs 30 and 31 are filled with water to provide an effective liquid seal between the windbox 20 and the combustion chamber 13. To prevent dirt and dust from accumulating in the troughs 30 and 31, wiper seals 34** are provided.

Figure 2:
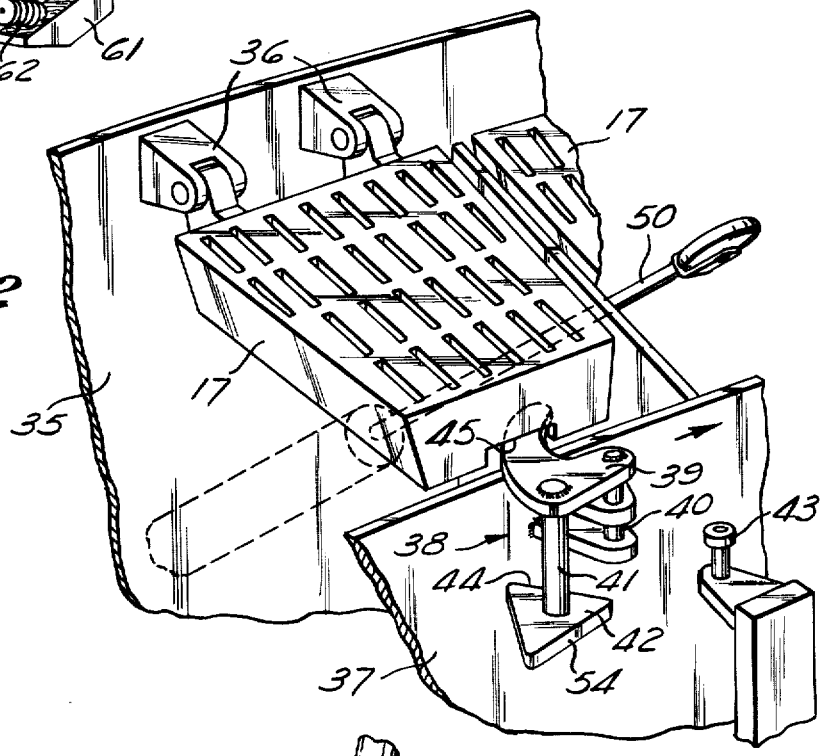
FIG. 2 is a fragmentary perspective view of the pallet latching mechanism.
Figure 6:
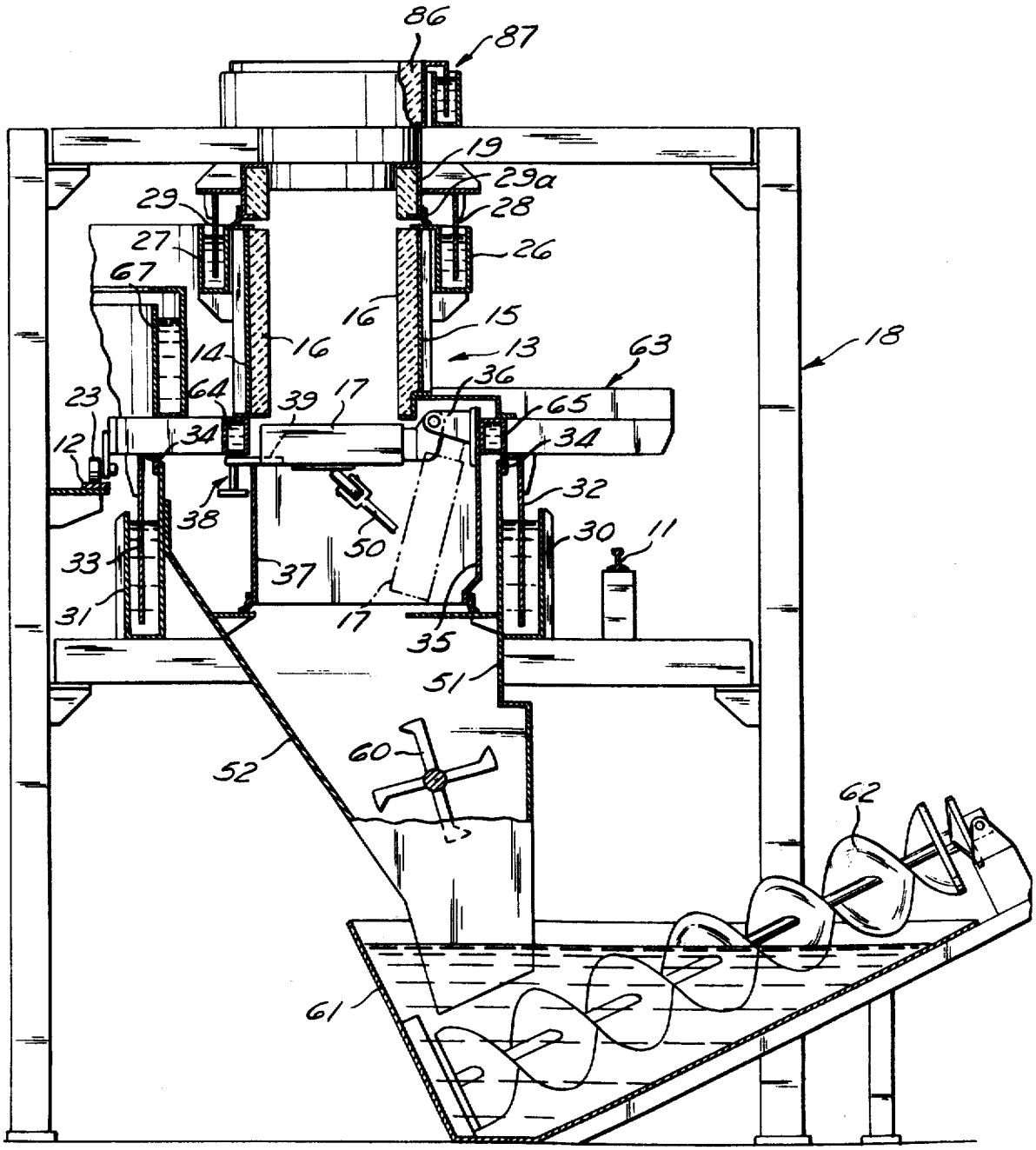
FIG. 6 is a fragmentary cross sectional view of the machine, the plane of the section being indicated by the line 6—6 in FIG. 1.

As was previously indicated, spent shale oil rock is discharged at a discharge station, which is shown most clearly in FIG. 6. To effect the discharge, each pallet is hinged to a lower outer wall 35 by hinges 36 and is normally pinned to an inner lower wall 37 by a latch assembly 38. The latch assembly 38 is most clearly shown in FIG. 2 and includes a latch member 39 pivotally connected to the wall 37 by a pin 40. The latch member has a pin 41 and a triangular cam 42 depending therefrom in the path of a first stationary cam 43. The stationary cam 43 is fixed to the stationary frame of the machine.

Figure 3:
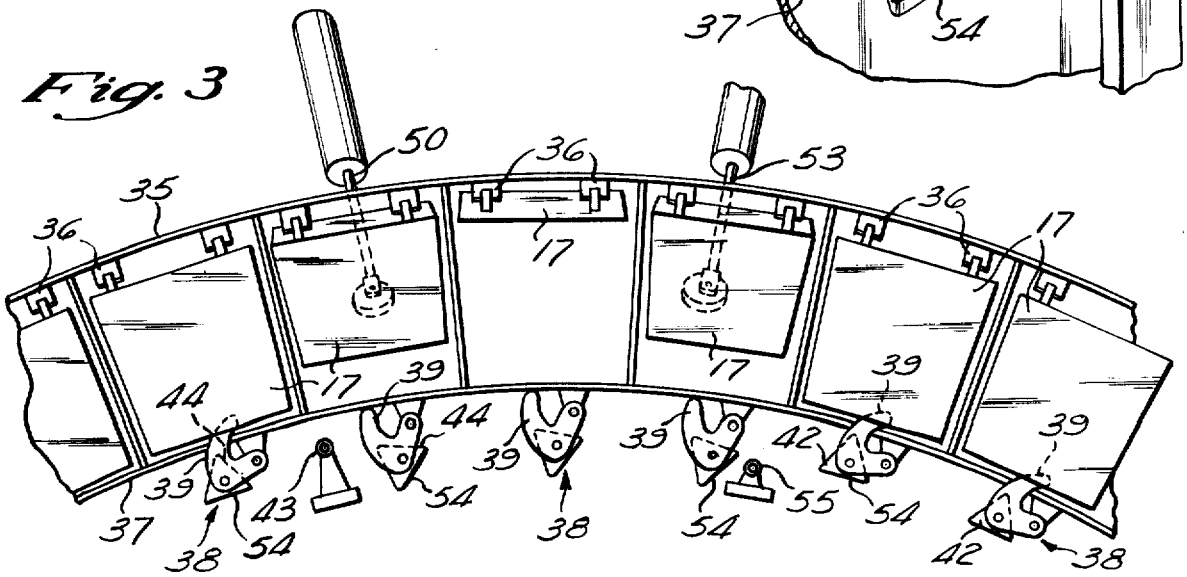
FIG. 3 is a fragmentary plan view of some of the pallets of the machine showing pallets in the discharge zone.

As each pallet approaches the discharge zone, one face 44 of each triangular cam 42 strikes the cam 43 to pivot the latch 39 in a counterclockwise direction and out of engagement with a recess 45 in each pallet 17. The released pallet does not drop suddenly but, rather, is lowered by a hydraulically operated piston and cylinder 50 which projects through a stationary wall 51 in a discharge chute 52. Thus, just prior to disengagement of the latch 39, the piston rod 50 lifts the pallet slightly to relieve the pressure of the latch and then as soon as the latch is released, the piston 50 guides the pallet to a lowered position, as may be seen most clearly in FIGS. 3 and 6. The moving pallet is then engaged by a second hydraulically operated piston and cylinder 53 and is returned to its normal horizontal position. With the piston 53 holding the pallet in this position, a second face 54 of the triangular cam 42 engages a stationary cam 55 to drive the latch 39 into the recess 45. Thereupon the piston 53 is retracted to pick up the next pallet 17. The timing of the pistons 50 and 53 may be correlated to the movement of the latches 39 by any suitable sensing means, such as limit switches, photocells, or the like.

The spent shale is dropped into the discharge chute 52 and any large chunks are broken up by rotating blades 60. The chute 52 is sealed by a water trough 61, having a screw conveyor 62 therein, which conveys the spent shale to a suitable discharge point.

Figure 7:
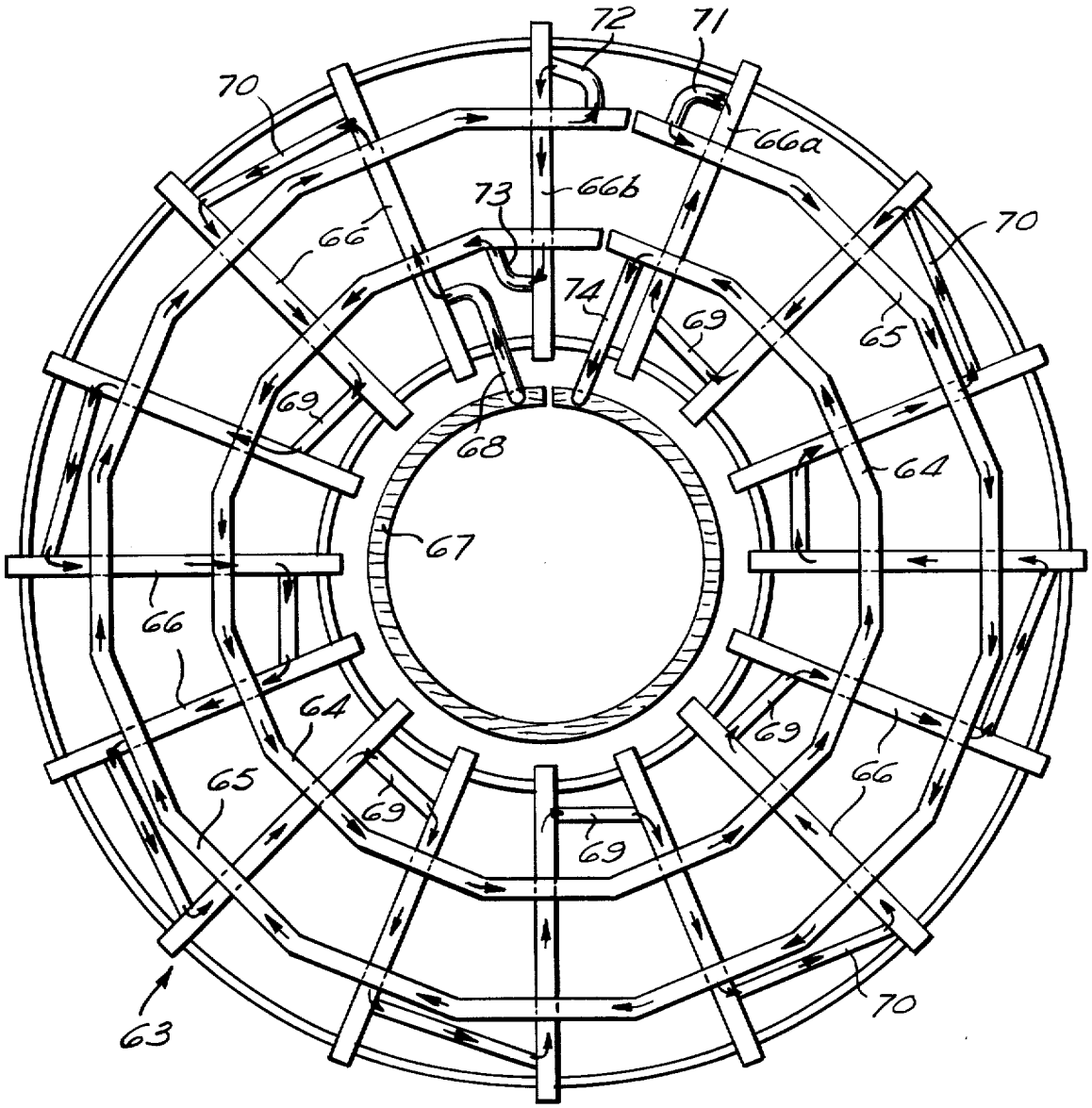
FIG. 7 is a plan view of the supporting grid indicating the path and direction of coolant flow within the grid.

As was previously indicated, the rotating conveying portion of the machine is supported by the grid 63 (FIG. 7), which is water-cooled to minimize differential expansion and contraction in the machine. The grid 63 includes inner and outer hollow circular concentric means 64 and 65, respectively, and radially extending beams 66 which are hollow and are in fluid communication with the beams 64 and 65. A coolant such as water is circulated through the beams 64, 65 and 66, from a reservoir 67. The water is pumped from the reservoir 67 through a conduit 68 and then to one of the beams 66. The water flows to all other beams 66 in the path indicated by the arrows in FIG. 7 through suitable inner and outer crossovers 69 and 70, respectively. When the flow reaches a beam **66*a*, it is transferred to the outer circular beam 65 by way of a conduit 71. After completing its circuit, it is transferred back to a radial beam 66*b* by way of a conduit 72, and then flows through a conduit 73 to circulate through the inner circular beam 64. After completing its circuit through the beam 64, it is transferred back to the reservoir through a conduit 74**.

A typical process for educting oil from oil shale is set forth in U.S. Pat. No. 3,325,395, the subject matter of which is incorporated herein by reference. Briefly stated, oil-bearing shale is charged into the machine by a conveyor belt 80 and into a feed chute 81. The pallets bearing the charge of shale proceed successively through a plurality of zones. In the first zone, or distilling zone, the burden is exposed to hot reducing or neutral gasses at a temperature broadly in the range of 1,000° F to 1,500° F, and desirably from about 1,200° F to about 1,400° F, by passing gasses through the bed in either updraft or downdraft direction. In the embodiment set forth in U.S. Pat. No. 3,325,395, the hot gasses are passed downwardly through the burden or bed to elevate its temperature to an oil educting temperature of about 800° F. The temperature of the bed usually follows a gradient, which varies with the stage or zone and the nature (i.e. cooling or heating) and direction of the gas flow. The hot gasses cause thermal removal of the oil from the shale and conversion into three fractions: carbonaceous oil, volatile oil fractions, and combustible gasses. The volatile and gasified fractions are conducted as a mist or oil fog through the underlying layers of charge material and through the relatively cooler pallets. The oil fog is then conducted though a suitable separator, such as a cyclone separator, where the gasses are simultaneously cooled and spun about an axis in such a manner to centrifugally deposit the suspended and condensed particles of oil on the cool surface of the separator to produce separately oil and oil depleted gasses. Any suitable oil recovery means may be used. Other oil may not be contained as a fog in the gas, but may drip directly from the pallets where it is collected by any suitable means such as barrels 85.

An access hatch 86 is provided through the hood 19 for maintenance purposes, and is sealed by a water seal 87.

Although preferred embodiments of this invention are illustrated, it should be understood that various modifications and rearrangements of parts may be resorted to without departing from the scope of the invention disclosed and claimed herein.

What is claimed is:

1. A circular traveling grate machine comprising a circular trackway, annular burden confining means mounted for movement along said trackway, said burden confining means having spaced inner and outer vertical walls and a plurality of gas permeable pallets pivotally mounted with respect to a horizontal plane to one of said walls and releasably connected by pin means to the other of said walls, means for moving said burden confining means and said plurality of pallets along said trackway, stationary gas confining hood means disposed over said inner and outer walls, stationary gas confining windbox means disposed under said inner and outer walls, sealing means between the inner and outer walls and the hood and windbox means, a discharge station defined by a portion of said inner and outer walls, said hood means and a spent burden receiving chute, means to sequentially release the pin means as each pallet enters the discharge station, means to guide each released pallet downwardly to a discharge position as each such pallet is pivoted under the influence of gravity, means to raise each pallet from its discharge position to its connected position, and means to sequentially perform the connection between each pallet and its pin means as each pallet leaves the discharge zone.

2. A circular traveling grate machine comprising a circular trackway, annular burden confining means mounted for movement along said trackway, said burden confining means having spaced inner and outer vertical walls and a plurality of gas permeable pallets, each of said pallets being hinged to one wall by hinge means and releasably connected to the other wall by releasable connection means, means for moving said burden confining means and said plurality of pallets along said trackway, stationary gas confining hood means disposed over said inner and outer walls, stationary gas confining windbox means disposed under said inner and outer walls, sealing means between the inner and outer walls and the hood and windbox means, a discharge station defined by a portion of said inner and outer walls, said hood means and a spent burden receiving chute, means to sequentially release the connection means between each pallet and said one wall as each pallet enters the discharge station, means to guide each released pallet downwardly to a discharge position as each such pallet is pivoted on its hinge under the influence of gravity, means to raise each pallet from its discharge position to its connected position with respect to said one wall, and means to sequentially perform the connection between each pallet and said one wall as each pallet leaves the discharge zone.

3. A circular traveling grate machine according to claim 2 wherein said releasable connection means comprises latch means pivotally connected to said one wall and having a distal portion in releasable engagement with a pallet.

4. A circular traveling grate machine according to claim 3 wherein said means to release said latch means and wherein said means to perform said connection comprise stationary cam means respectively located adjacent the entrance to and the exit from said discharge zone.

5. A circular traveling grate machine according to claim 2 wherein said means to guide each released pallet downwardly and said means to raise each pallet comprise piston and cylinder means respectively located adjacent the entrance to and the exit from said discharge zone.

6. A circular traveling grate machine according to claim 5 wherein said pallets are hinged to said outer wall.

7. A circular traveling grate machine comprising a circular trackway, annular burden confining means mounted for movement along said trackway, said burden confining means having spaced inner and outer vertical walls and a plurality of gas permeable pallets hinged to one wall by hinge means and releasably connected to the other wall by releasable connection means, said burden confining means being supported for rotation along said trackway by a supporting grid, said supporting grid comprising inner and outer generally circular beams supporting said inner and outer walls, and a plurality of radially extending beams, said inner and outer and said radially extending beams being hollow and in fluid communication with each other to define a flow path for a coolant within said supporting grid, means for moving said burden confining means and its supporting grid along said trackway, stationary gas confining hood means disposed over said inner and outer walls, stationary gas confining windbox means disposed under said inner outer walls, and sealing means between the inner and outer walls and the hood and windbox means, a discharge station defined by a portion of said inner and outer walls, said hood means and a spent burden receiving chute, means to sequentially release the connection means between each pallet and said one wall as each pallet enters the discharge station, means to guide each released pallet downwardly to a discharge position as each such pallet is pivoted on its hinge under the influence of gravity, means to raise each pallet from its discharge position to its connected position with respect to said one wall, and means to sequentially perform the connection between each pallet and said one wall as each pallet leaves the discharge zone.

8. A circular traveling grate machine according to claim 7 wherein said releasable connection means comprises latch means pivotally connected to said one wall and having a distal portion in releasable engagement with a pallet.

9. A circular traveling grate machine according to claim 8 wherein said means to release said latch means and wherein said means to perform said connection comprise stationary cam means respectively located adjacent the entrance to and the exit from said discharge zone.

10. A circular traveling grate machine according to claim 7 wherein said means to guide each released pallet downwardly and said means to raise each pallet comprise piston and cylinder means respectively located adjacent the entrance to and the exit from said discharge zone.

11. A circular traveling grate machine according to claim 10 wherein said pallets are hinged to said outer wall.

* * * * *